United States Patent [19]

Hansen

[11] Patent Number: 4,790,463

[45] Date of Patent: Dec. 13, 1988

[54] DIVER'S BAG

[75] Inventor: Larsin Hansen, Stavanger, Norway

[73] Assignee: Viking-Stavanger A/S, Stavanger, Norway

[21] Appl. No.: 67,863

[22] Filed: Jun. 30, 1987

[51] Int. Cl.[4] ..... B65D 30/00

[52] U.S. Cl. ..... 224/253; 224/153; 128/202.14; 405/210; 114/315; 383/3

[58] Field of Search ..... 114/54, 315, 321; 224/153, 151, 209, 259; 383/3, 59; 206/810, 811; 128/202.14; 405/210; 441/32, 125, 6

[56] References Cited

U.S. PATENT DOCUMENTS

| | | | |
|---|---|---|---|
| 1,864,648 | 6/1932 | Haines | 441/125 |
| 2,001,673 | 5/1935 | Davis | 128/202.14 |
| 2,371,404 | 3/1945 | Mumford | 441/32 |
| 3,536,071 | 10/1970 | Ferrando | 128/202.14 |
| 3,732,837 | 5/1973 | Hogan | 114/315 |
| 3,777,489 | 12/1973 | Johnson et al. | 60/226 R |
| 4,157,134 | 6/1979 | Stoll | 441/125 X |

FOREIGN PATENT DOCUMENTS

| | | |
|---|---|---|
| 132272 | 7/1975 | Norway . |
| 423747 | 5/1982 | Sweden . |
| 423848 | 5/1982 | Switzerland . |

*Primary Examiner*—Henry J. Recla
*Assistant Examiner*—David Voorhees
*Attorney, Agent, or Firm*—Fleit, Jacobson, Cohn & Price

[57] ABSTRACT

Bag for use by divers for transporting articles under water, including valves for controlling the buoyancy of the bag under water. An essential consideration is that this transportation shall take place while the articles are kept dry, for example tools or materials to be used in diver operations. According to the invention a receptacle (10) for articles to be transported, constitutes a buoyancy chamber, and is provided with at least one unidirectional valve (15, 16, 18) for buoyancy control, as well as a watertight closure, preferably a zipper (4) for an opening to the receptacle (10).

6 Claims, 2 Drawing Sheets

DIVER'S BAG

In various diver's operations there is a need for a transporting bag or sack which the diver can bring with him at the water surface and in particular under water, for keeping dry and transporting for example tools and materials to be used during the operations.

A specific problem with such auxiliary means for divers is that the bag must be suitable for use at varying water depths, and thus must comprise means for regulating the buoyancy of the bag under water. From U.S. Pat. No. 3,777,498 is known a flexible diver's bag which can be inflated by the diver himself, and which is aimed at the transportation of articles, in particular game such as fish, lobsters and the like. Thus, this known diver's bag has a net-like perforated bag adapted to accommodate the articles to be transported. Therefore these are not kept dry within the bag or sack, which is not of any significance in the uses for which this known diver's bag is intended. The design in other respects, including control devices, also is of such nature that the known diver's bag is not at all suitable for such purposes as stated above.

What is novel and specific to the bag according to the invention in the first place consists therein that a receptacle for articles to be transported, constitutes a buoyancy chamber and is provided with at 1-east one unidirectional valve for buoyancy control, as well as a watertight closure for an opening to the receptacle.

With this new bag design there is obtained a number of advantages, inter alia high security under use since adjustment of the buoyancy easily can be effected during diving, and the diver can comfortably move at varying depths, possibly at the surface, bringing with him the bag in different ways, for example situated against the belly.

Figure 1:
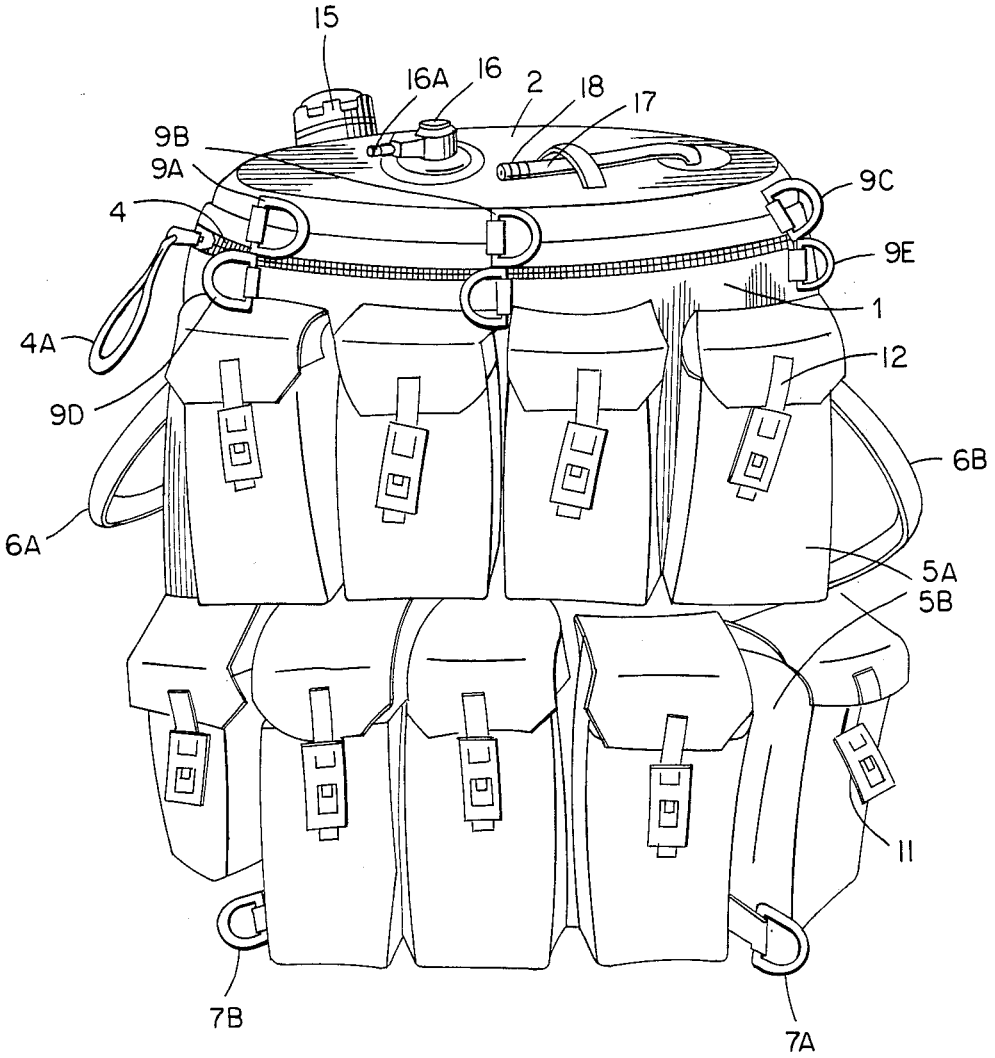
Figure 3:
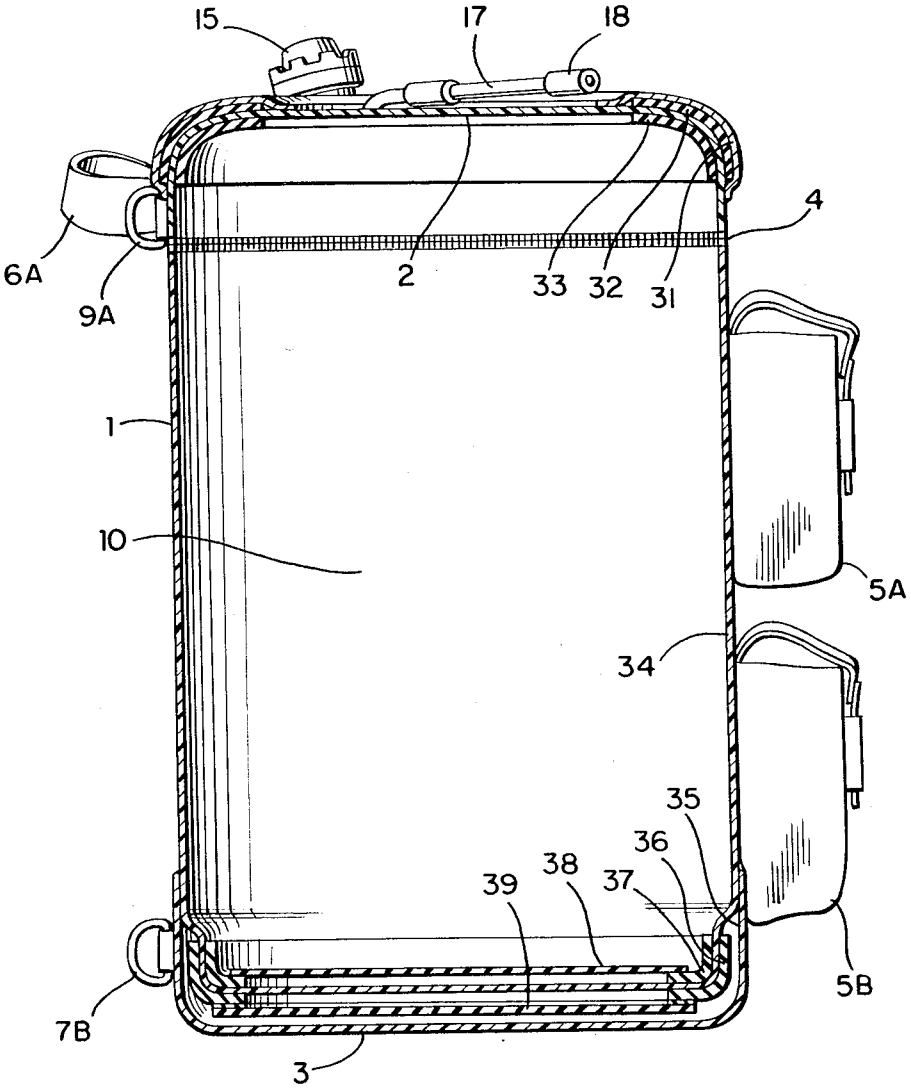
Figure 2:
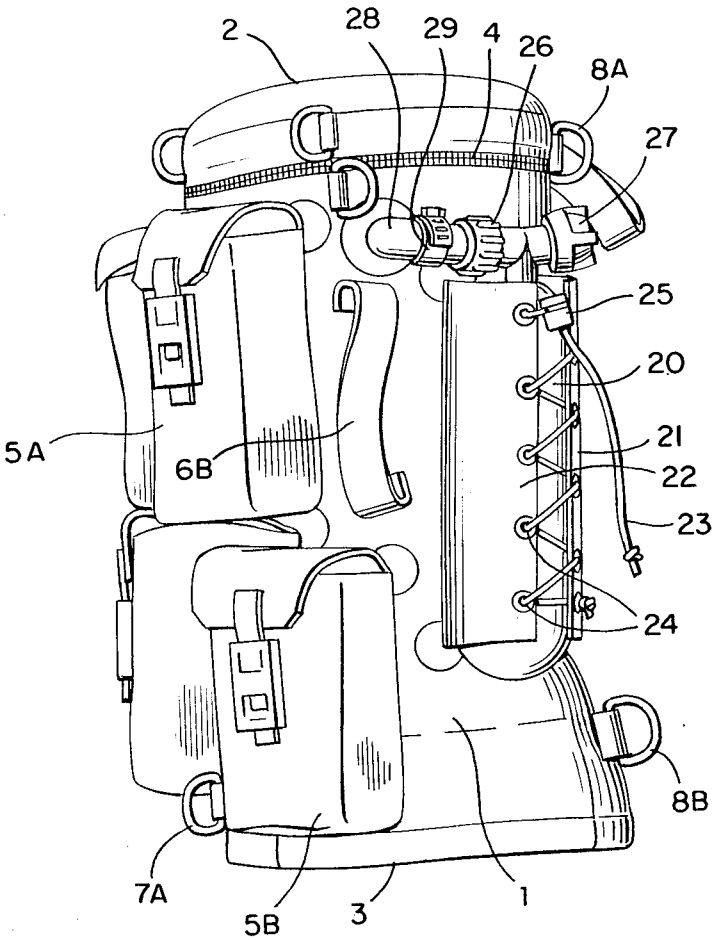

The invention, together with additional advantages and particular features thereof, shall be explained more closely in the following with reference to the drawings, wherein:

FIG. 1 shows an embodiment of the bag according to the invention, seen in elevation from the rear, FIG. 2 shows the bag in FIG. 1 seen from one side, and FIG. 3 shows a cross-section through the bag.

As will be seen in the figures of drawings the bag has a rucksack-like shape, consisting of a body part 1 having a lid 2 and a bottom 3. These parts enclose a receptacle 10 the size and shape of which can be adapted to the uses for which the bag is intended. As mentioned it can be practical to give the bag a rucksack-like shape, whereby the lid 2 by means of a closure in the form of a watertight zipper 4, is brought to engage the body part 1 tightly.

By means of one or more valves and other expedients to be described more closely below, the bag is so designed that the receptacle 10 for articles to be transported, at the same time is a buoyancy chamber which is required for the use of such a bag in diver operations. Thus, there is shown a discharge valve 15 which is a unidirection valve and can be automatic, possibly also adapted for manual operation, for controlling the buoyancy. Such valves are previously known per se, and an example may be found in Norwegian Patent Specification No. 132272.

Moreover, there is shown a flexible hose 17 the free end of which is provided with a unidirectional valve 18 associated with a mouthpiece for oral inflatation of the buoyancy chamber, i.e. The receptical 10. Inflation with air through the hose 17 and the valve 18 can be effected by the diver both above water and under water.

As a rule, however, the introduction or filling of air into the bag will take place by means of an air pressure provided for in a different manner, and for this purpose, inter alia, there is provided a particular inlet valve 16 with a fitting 16A for a hose or the like. Also here there is question of a unidirectional valve, for example of a similar design as the one described in Swedish Patent Specification No. 7812433.6 (Publication No. 423747). Such valves can, inter alia, be designed for preventing the entering of water. A particularly interesting possibility in connection with the inlet valve 16 and the fitting 16A is that compressed air equipment which belongs to usual diver suits can be connected to the fitting 16A for controlling the buoyancy of the bag.

For obtaining a secure and reliable air supply for buoyancy control during diver operations (as will appear especially from FIG. 2), the bag additionally is provided with a pressure bottle 20 which on its top has a connecting device 26 and a control valve 27 with a manually rotatable knob or the like, which through a rubber hose 28 is connected to the interior of the bag. A common hose clamp 29 is shown at the connection between the hose 28 and the coupling device 26. The latter coupling device in the usual manner can be based upon screw threads or the like. For attaching the pressure bottle 20 on the bag there are shown flaps 21 and 22 with holes 24 for a string 23 which can be tightened by means of a fastening or locking device 25.

With the indicated location of the various valves and buoyancy control means the diver when using the bag will comfortably be able to attend to the necessary regulation, either manually (orally) or by means of the pressure bottle 20. In this connection it is particularly important that the controls or knobs for valves 15 and 27 as well as the mouthpiece with valve 18 are easily accessible during the operation.

Other important structural features are concerned with the zipper 4 which can per se be of previously known design. The actual sliding clip can be provided with a strong strap 4A for easy manipulation. Besides, there are shown a number of gripping members in the form of half circular or D-shaped rings 9A, 9B and 9C at the upper side of the zipper 4 (see FIG. 1), and corresponding gripping members at the underside along the zipper. At the underside there are particularly indicated two such rings 9D and 9E. These rings will to a large extent facilitate opening and closing of the zipper, since the flexibility of the material constituting the actual body part 1 and the lid 2 of the bag, according to the circumstances can make it difficult to operate the comparatively heavy zipper 4.

With the indicated arrangement of the zipper 4 which runs around a substantial portion of the circumference around the opening to the receptical 10, there is obtained a diver's bag which is very practical and comfortable in use.

In addition to the specific features of the bag design as discussed above, the embodiment in the drawing also comprises additional features, of which several are more or less necessary depending on the intended use. For example there are shown a number of outside pockets which are not intended to be watertight. Two such pockets are shown at 5A and 5B. In the usual manner these pockets can have a fastening strap 12 as shown at the pocket 5A, and a cooperating buckle as shown at 11 on pocket 5B.

At the sides of the bag there can be provided carrying handles or straps 6A and 6B. For attachment or fastening there can, moreover, be provided additional rings as shown for example at 7A, 7B, 8A and 8B, which can for example have a similar design as rings 9A–9E along the zipper 4. Particularly the rings 8A and 8B (see FIG. 2) and similar rings at the other side, can serve for attachment by means of belts or the like, so that the bag can be carried as a common rucksack. Elements for cooperation with a frame as on rucksacks may also be provided at that side of the bag which is not provided with carrying pockets.

Finally the cross-sectional illustration of FIG. 3 shows the design of certain portions of the bag being specifically reinforced. Especially the bottom 3 can be subjected to high stresses and thus in addition to the material layer 34 constituting the body part 1, also comprises a corresponding additional material layer 35 forming a double bottom, with reinforcement bands 36 and 37 of rubber at the corner portions, as well as rubber layers 38 and 39 at the inside of the respective material layers 34 and 35. The upper right corner of the lid 2 in FIG. 3 comprises an extra outer material layer 31 and rubber bands 32 and 33 as shown.

The main material in the bag can be a coated textile material, for example of polyamid which is covered with rubber and accordingly adapted to give a good adhesion of the rubber. Obviously there is available many different materials for this purpose, for example materials known in connection with the manufacture of diver's suits. When the complete bag has been built up it is suitably subjected to a vulcanizing process. This results in the joining of all rubber coated parts into a unitary, integral and watertight structure.

I claim:

1. A bag for use by divers for transporting articles under water comprising;

an endless side wall open at either end;

means closing both ends of the endless side wall which together with the endless side wall forms a watertight hollow receptacle having an inner cavity forming a single buoyancy chamber;

means for manually carrying the bag attached to said receptacle;

unidirectional valve means mounted on said receptacle for buoyancy control of the single buoyancy chamber;

a plurality of watertight inflation means mounted on said receptacle communicating with the single buoyancy chamber;

wherein gas can be supplied to said single buoyancy chamber by said plurality of watertight inflation means and discharged from said single buoyancy chamber by said unidirectional valve means to provide the bag with a variable buoyancy, said single buoyancy chamber forming the sole buoyancy chamber of the bag wherein the means closing one end of said endless sidewall comprises: a lid; and a watertight zipper extending about one end of the endless sidewall between said endless sidewall and said lid, said zipper movable between a first position in which said lid engages said endless sidewall in a watertight manner to form said single buoyancy chamber and a second position in which said lid is movable away from said sidewall.

2. A bag as defined by claim 1, wherein said plurality of watertight inflation means comprise an inlet valve disposed on said lid; and a flexible hose including a fixed end, affixed to said lid, and a free end, and a unidirecitonal valve provided at said free end, so that said single buoyancy chamber is orally inflatable by a diver.

3. A bag as defined by claim 2, wherein said plurality of watertight inflation means further comprises a bottle containing compressed gas attached to the endless side wall of the bag;

a connecting device and a manually adjustable control valve provided on said bottle; and a hose extending between said inner cavity and said connecting device, so that upon moving said manually adjustable control valve from a closed to an open position, compressed gas passes from said bottle into said inner cavity to increase buoyancy of the bag.

4. A bag as defined by claim 3, wherein the endless side wall of the bag comprises a pair of flaps, each including a plurality of holes;

a string passing through each of said holes; and a fastening device through which ends of said string pass so that said string can be tightened to draw each of said flaps tightly about the exterior of said bottle to attach the bottle to the endless side wall of said bag.

5. A bag as defined by claim 3, wherein a plurality of auxiliary pockets are provided on the endless side wall of the bag.

6. A bag as defined by claim 5, wherein the means closing the other end of the endless side wall comprises a first material layer integral with said endless side wall and including inner and outer sides;

rubber reinforcement means disposed on each of said inner and outer sides; and an additional material layer secured to the endless side wall of said bag and enclosing the rubber reinforcement means disposed on said outer side between the outer side and an inner side of the additional material layer.

* * * * *